US006925732B1

(12) United States Patent
Clarke

(10) Patent No.: US 6,925,732 B1
(45) Date of Patent: Aug. 9, 2005

(54) FOOTWEAR WITH SEPARATED UPPER AND SOLE STRUCTURE

(75) Inventor: Richard Douglas Clarke, Portland, OR (US)

(73) Assignee: Nike, Inc., Beaverton, OR (US)

( * ) Notice: Subject to any disclaimer, the term of this patent is extended or adjusted under 35 U.S.C. 154(b) by 16 days.

(21) Appl. No.: 10/464,868

(22) Filed: Jun. 19, 2003

(51) Int. Cl.[7] ..... A43B 13/18; A43B 13/20
(52) U.S. Cl. ..... 36/27; 36/28; 36/35 R; 36/31
(58) Field of Search ..... 36/27, 28, 30 R, 36/31, 35 R, 89, 7.8, 25 R

(56) References Cited

U.S. PATENT DOCUMENTS

| | | | | |
|---|---|---|---|---|
| 75,900 | A | | 3/1868 | Hale et al. |
| 337,146 | A | | 3/1886 | Gluecksmann |
| 413,693 | A | | 10/1889 | Walker |
| 427,136 | A | | 5/1890 | Walker |
| 733,167 | A | | 7/1903 | Denton |
| 2,413,545 | A | | 12/1946 | Cordi |
| 4,091,472 | A | | 5/1978 | Daher et al. |
| 4,360,978 | A | | 11/1982 | Simpkins |
| 4,492,046 | A | * | 1/1985 | Kosova |
| 4,566,206 | A | | 1/1986 | Weber |
| 4,652,266 | A | | 3/1987 | Truesdell |
| 4,822,363 | A | | 4/1989 | Phillips |
| 4,892,554 | A | | 1/1990 | Robinson |
| 4,910,885 | A | | 3/1990 | Hsieh |
| 5,138,776 | A | * | 8/1992 | Levin ..... 36/38 |
| 5,159,767 | A | | 11/1992 | Allen |
| 5,203,095 | A | | 4/1993 | Allen |
| 5,279,051 | A | * | 1/1994 | Whatley |
| 5,367,750 | A | | 11/1994 | Ward |
| 5,367,790 | A | | 11/1994 | Gamow et al. |
| 5,435,079 | A | * | 7/1995 | Gallegos ..... 36/38 |
| 5,701,686 | A | | 12/1997 | Herr et al. |
| 5,743,028 | A | * | 4/1998 | Lombardino ..... 36/27 |
| 6,029,374 | A | | 2/2000 | Herr et al. |
| 6,115,942 | A | * | 9/2000 | Paradis |
| 6,131,309 | A | * | 10/2000 | Walsh |

(Continued)

FOREIGN PATENT DOCUMENTS

| | | |
|---|---|---|
| DE | 34 15705 | 10/1985 |
| EP | 0 103 041 | 3/1986 |
| FR | 1227420 | 4/1960 |
| FR | 81 11304 | 12/1982 |
| WO | WO 01/87106 | 11/2001 |

*Primary Examiner*—M. D. Patterson
(74) *Attorney, Agent, or Firm*—Banner & Witcoff, Ltd.

(57) ABSTRACT

The invention is an article of footwear with an upper and a sole structure. The primary components of the sole structure are a midsole and a frame element. The midsole is connected to the upper in a forefoot region of the footwear, but is unconnected to the upper in a rearfoot region of the footwear. The frame element is structured to extend onto a heel portion of the upper and around the heel portion to thereby stabilize the heel portion. The frame element may serve as a spring that provides cushioning in combination with the midsole. The configuration of the frame element, which extend onto the heel portion of the upper, leaves a lower surface of the upper exposed to permit direct contact with the midsole.

16 Claims, 3 Drawing Sheets

U.S. PATENT DOCUMENTS 6,282,814 B1 * 9/2001 Krafsur et al. ..... 36/27
6,341,432 B1 * 1/2002 Muller
6,449,878 B1 * 9/2002 Lyden
6,487,796 B1 * 12/2002 Avar et al.
6,557,271 B1 * 5/2003 Weaver, III
6,568,102 B1 * 5/2003 Healy et al.
6,722,058 B2 * 4/2004 Lucas et al.
2002/0129516 A1 * 9/2002 Lucas
2002/0144430 A1 * 10/2002 Schmid
2003/0188455 A1 * 10/2003 Weaver, III

* cited by examiner

FOOTWEAR WITH SEPARATED UPPER AND SOLE STRUCTURE

BACKGROUND OF THE INVENTION

1. Field of the Invention

The present invention relates to footwear. The invention concerns, more particularly, athletic footwear having an upper and a sole structure with a bifurcated construction.

2. Description of Background Art

Conventional articles of athletic footwear include two primary elements, an upper and a sole structure. The upper is usually formed of leather, synthetic materials, or a combination thereof and comfortably secures the footwear to the foot, while providing ventilation and protection from the elements. The sole structure often incorporates multiple layers that are conventionally referred to as an insole, a midsole, and an outsole. The insole is a thin, cushioning member located within the upper and adjacent the sole of the foot to enhance footwear comfort. The midsole, which is traditionally attached to the upper along the entire length of the upper, forms the middle layer of the sole structure and serves a variety of purposes that include controlling potentially harmful foot motions, such as over pronation; shielding the foot from excessive ground reaction forces, and beneficially utilizing such ground reaction forces for more efficient toe-off. In order to achieve these purposes, the midsole may have a variety of configurations, as discussed in greater detail below. The outsole forms the ground-contacting element of footwear and is usually fashioned from a durable, wear resistant material that includes texturing to improve traction.

The primary element of a conventional midsole is a resilient, polymer foam material, such as polyurethane or ethylvinylacetate, that extends throughout the length of the footwear. The properties of the foam midsole are primarily dependent upon factors that include the dimensional configuration of the midsole, the material selected for the polymer foam, and the density of the midsole material. By varying these factors throughout the midsole, the relative stiffness, degree of ground reaction force attenuation, and energy absorption properties may be altered to meet the specific demands of the activity for which the footwear is intended to be used.

In addition to foam materials, conventional midsoles may include, for example, stability devices that resist over-pronation and moderators that distribute ground reaction forces. The use of foam midsole materials in athletic footwear, while providing protection against ground reaction forces, may introduce instability that contributes to a tendency for over-pronation. Pronation is the inward roll of the foot while in contact with the ground. Although pronation is normal, it may be a potential source of foot and leg injury, particularly if it is excessive. Stability devices are often incorporated into foam midsoles to control the degree of pronation in the foot. Examples of stability devices are found in U.S. Pat. No. 4,255,877 to Bowerman; U.S. Pat. No. 4,287,675 to Norton et al.; U.S. Pat. No. 4,288,929 to Norton et al.; U.S. Pat. No. 4,354,318 to Frederick et al.; U.S. Pat. No. 4,364,188 to Turner et al.; U.S. Pat. No. 4,364,189 to Bates; and U.S. Pat. No. 5,247,742 to Kilgore et al. In addition to stability devices, conventional midsoles may include fluid-filled bladders, as disclosed in U.S. Pat. Nos. 4,183,156 and 4,219,945 to Marion F. Rudy.

As an alternative to the conventional midsole structures discussed above, various articles of footwear include a spring within the sole structure. For example, U.S. Pat. No. 4,566,206 to Weber discloses an article of footwear having a spring positioned in the heel area of the sole structure. The spring includes an upper portion and an intermediate portion that are joined to a lower portion to form acute angles with the lower portion. U.S. Pat. No. 5,367,790 to Garnow et al. discloses an article of footwear with a spring having a collapsible longitudinal arch. The spring includes an upper plate and a lower plate joined together approximately two-thirds of the distance from the rear of the footwear to the front of the footwear. A similar configuration is disclosed in U.S. Pat. Nos. 5,701,686 and 6,029,374 to Herr et al., which also discloses a forefoot plate that provides a spring in the fore portions of the footwear. U.S. Pat. No. 4,492,046 to Kosova discloses an article of footwear with a sole structure that incorporates a spring wire.

SUMMARY OF THE INVENTION

The invention is an article of footwear having an upper for receiving a foot of a wearer and a sole structure for supporting the foot. The primary components of the sole structure are a midsole and a frame element. The midsole is connected to the upper in a forefoot region of the footwear, but is preferably unconnected to the upper in a rearfoot region of the footwear. The frame element is structured to extend onto a heel portion of the upper and around the heel portion to thereby stabilize the heel portion. The frame element may serve as a spring that absorbs impact energy and attenuates ground reaction forces in combination with the midsole. The configuration of the frame element, which extend onto the heel portion of the upper, leaves a lower surface of the upper exposed to permit direct contact with the midsole.

The midsole may be structured to have two discrete elements, a fore element that is connected to the upper and a rear element that is substantially unconnected to the upper. The fore element is located in the forefoot region of the footwear and the rear element is located in the rearfoot region of the footwear. The frame element, which generally includes a support section and a heel section, may separate the fore element of the midsole and rear element of the midsole. In general, the support section and the heel section are joined in the area between the two elements of the midsole. The support section is positioned under the rear element of the midsole and provides additional support to the rear element. The heel section projects between the rear element of the midsole and the upper and extends onto the upper and around the heel portion of the upper. The heel section may, therefore, function to stabilize the heel portion of the footwear. In addition, the support section and the heel section of the frame element may act as a spring if the materials for the frame element are correctly selected. The upper may be configured such that a portion of the material forming the upper is suspended from the frame element.

In many conventional articles of footwear, the midsole is positioned directly under the upper and the boundaries of the midsole approximately correspond with the boundaries of the upper. In the footwear of the present invention, however, the sole structure may project beyond the upper in the rearward direction and in the medial-lateral direction.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The figures and following discussion disclose an article of footwear 100 in accordance with the present invention. Footwear 100 is depicted and discussed as a running shoe. The concepts disclosed with respect to the structure and function of footwear 100 may, however, be applied to athletic footwear intended for use in a wide variety of activities, including basketball shoes, tennis shoes, cross-training shoes, or soccer shoes, for example. The concepts may also be applied to many styles of non-athletic footwear, including work boots or dress shoes. The present invention is not limited, therefore, to a particular style of footwear, and may be applied to a wide range of footwear styles that are intended for a variety of activities.

Figure 1:
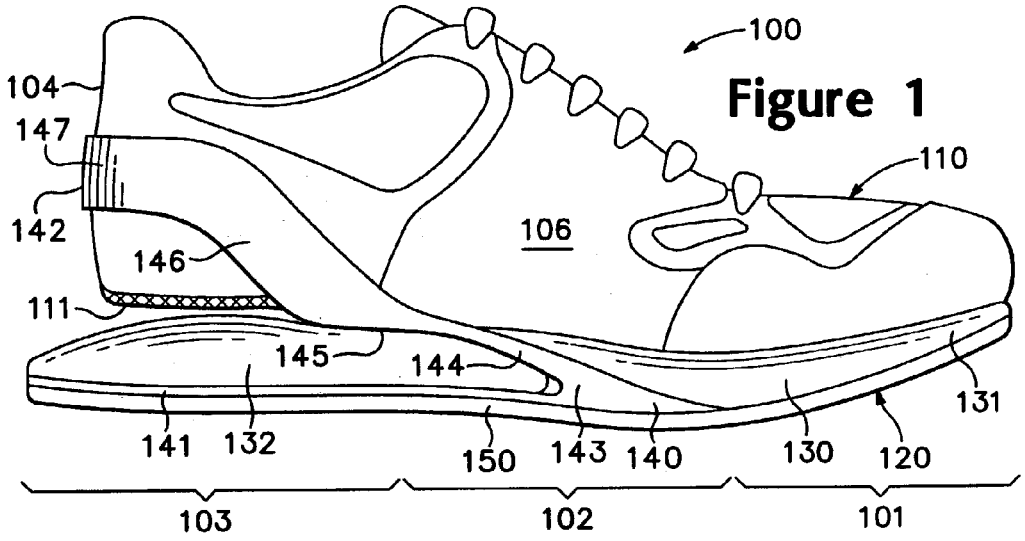
FIG. 1 is lateral side elevational view of an article of footwear incorporating the sole structure of the present invention.
Figure 2:
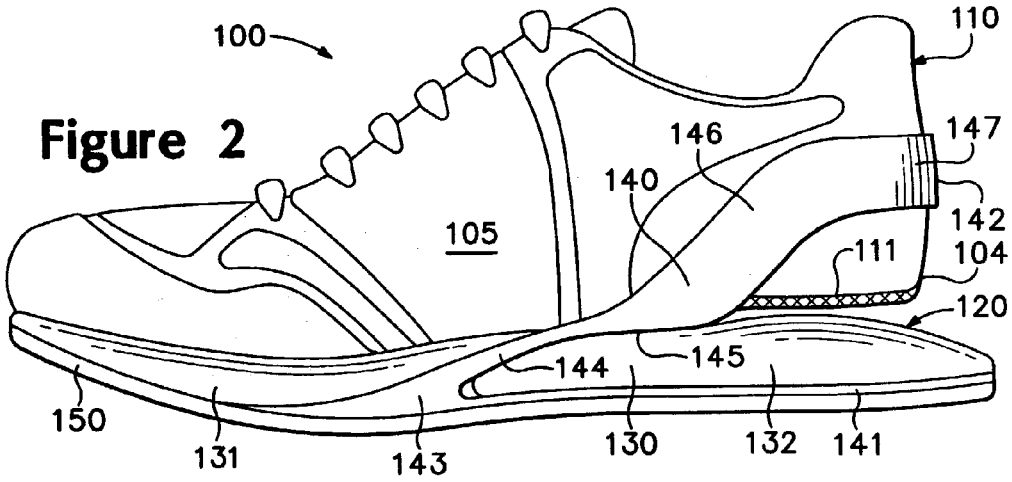
FIG. 2 is medial side elevational view of the article of footwear.

The primary elements of footwear 100, as depicted in FIGS. 1–4, are an upper 110 and a sole structure 120. The following discussion references various general areas of footwear 100, upper 110, and sole structure 120 based upon their relative locations. For reference purposes, footwear 100 may be divided into three general regions: a forefoot region 101, a midfoot region 102, and a rearfoot region 103, as depicted in FIG. 1. Forefoot region 101 generally includes portions of footwear 100 corresponding with the toes and the joints connecting the metatarsals with the phalanges. Midfoot region 102 generally includes portions of footwear 100 corresponding with the arch area of the foot, and rearfoot region 103 corresponds with rear portions of the foot, including the calcaneus bone. Regions 101–103 are not intended to demarcate precise areas of footwear 100. Rather, regions 101–103 are intended to represent general areas of footwear 100 to aid in the following discussion. Regions 101–103 may also be subdivided into further, more specific areas. For example, rearfoot region 103 may include a heel area 104 that corresponds with the specific portion of footwear 100 surrounding the heel of the wearer. In addition, footwear 100 has two general sides, a medial side 105 and a lateral side 106, as depicted in FIGS. 1 and 2, respectively.

Upper 110 may be any style of upper that receives the foot and comfortably secures the foot to footwear 100. As with conventional uppers intended for running or other athletic activities, upper 110 may be formed of synthetic materials, leather materials, or multiple layers of different materials that are stitched or adhesively bonded to each other. In addition, upper 110 may incorporate a lightweight, foam material that provides a compliant and comfortable structure for surrounding the foot. Depending upon the intended use for footwear 100, upper 110 may also be formed of breathable materials that permit air to freely enter and exit footwear 100, thereby removing perspiration or other moisture from the area immediately surrounding the foot. A portion of upper 110 positioned in rearfoot region 103 may be formed of a material 111 that extends under the heel of the foot of the individual. Material 111 may be a variety of materials, including a mesh material or a woven or non-woven textile. As will be described in greater detail below, material 111 may support the heel and permit ventilation of upper 110.

A section of sole structure 120 extends onto rear portions of upper 110, as will be discussed in greater detail below. In order to enhance the comfort of footwear 100 in rearfoot region 103, particularly in heel area 104, upper 110 may incorporate a leather or vinyl material that effectively separates the foot from the section of sole structure 120 that extends onto upper 110 and around heel area 104.

Sole structure 120 includes a midsole 130, a frame portion 140, and an outsole 150. Midsole 130 may be formed from a variety of resiliently-compressible materials that attenuate shock and absorb energy during running, walking, or other activities where footwear 100 impacts the ground. Unlike many conventional articles of footwear that have a single, integral midsole extending from the forefoot region to the rearfoot region, midsole 130 includes two discrete midsole elements, a fore element 131 and a rear element 132, that are separated by a portion of frame 140.

Fore element 131 and rear element 132 may be formed from a plurality of polymer foam materials that include ethylvinylacetate and polyurethane foam. When formed from ethylvinylacetate, fore element 131 may have a generally conventional hardness of 56 on the Asker C scale. Rear element 132 may be formed of a similar material, or may have a hardness that ranges between, for example, 46 and 52 on the Asker C scale. In some embodiments, the softer hardness of rear element 132 may be offset by a leather or thermoplastic polyurethane covering that extends over a top surface of rear element 132.

Fore element 131 extends throughout forefoot region 101 and into a portion of midfoot region 102. An upper surface of fore element 131 is attached to upper 110 and has a substantially planar configuration. A lower surface of fore element 131 is attached to outsole 150 in forefoot region 101 and attached to frame 140 in midfoot region 102. The thickness of fore element 131 increases from the front of forefoot region 101 to the point where fore element 131 connects to frame 140, and thereafter tapers to provide space for frame 140. From side elevational views, as depicted in FIGS. 1 and 2, fore element 131 therefore has a generally triangular configuration wherein a first side is the upper surface, which is connected to upper 110, a second side is the portion of the lower surface that is connected to outsole 150, and a third side is the portion of the lower surface that is connected to frame 140.

Figure 3:
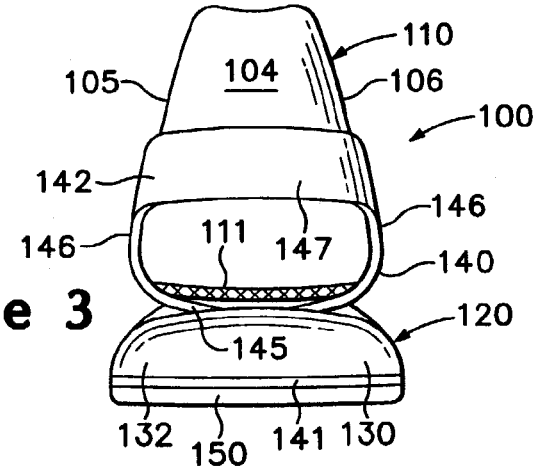
FIG. 3 is a rear elevational view of the article of footwear.
Figure 4:
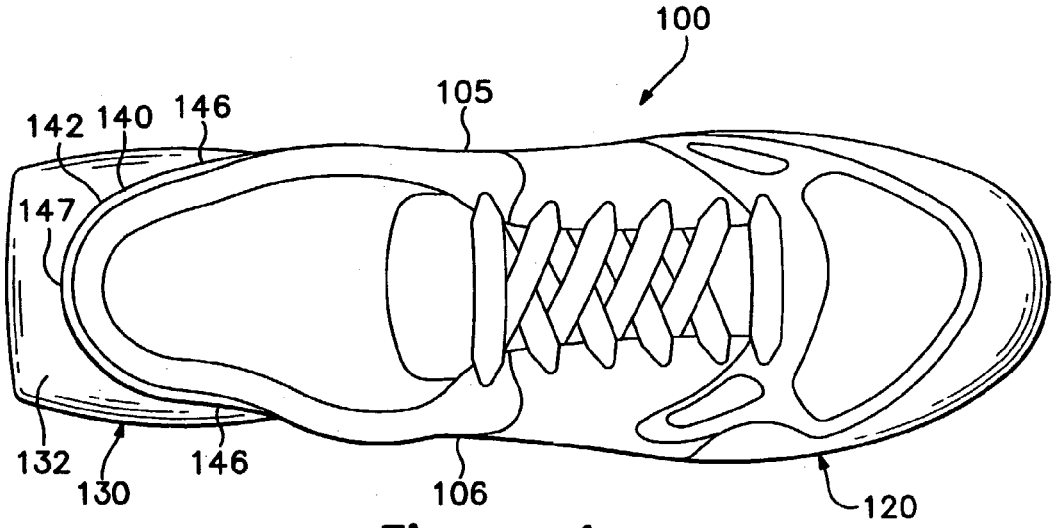
FIG. 4 is a top plan view of the article of footwear.

Rear element 132 extends rearward from an approximate midpoint of midfoot region 102. At least the portion of rear element 132 positioned in rearfoot region 103 extends rearward beyond heel area 104, as depicted in FIGS. 1, 2 and 4, and has a width that extends beyond the medial and lateral plane of upper 110, as depicted in FIGS. 3 and 4. Rear element 132 is substantially unconnected to upper 110, particularly in heel area 104. In midfoot region 102, however, the upper surface of rear element 132 is connected to frame portion 140 and a relatively small portion of the upper surface of rear element 132 may also be connected to upper 110. The upper surface of rear element 132 has a generally convex configuration along the length of footwear 100 and from medial side 105 to lateral side 106, the highest point being positioned under heel area 104. Forward and rear portions of rear element 132 have, therefore, a tapered configuration, with the forward portion being tapered to extend between sections of frame 140. The lower surface of rear element 132 is generally planar and a substantial portion of the lower surface is connected to frame 140.

Figure 5:
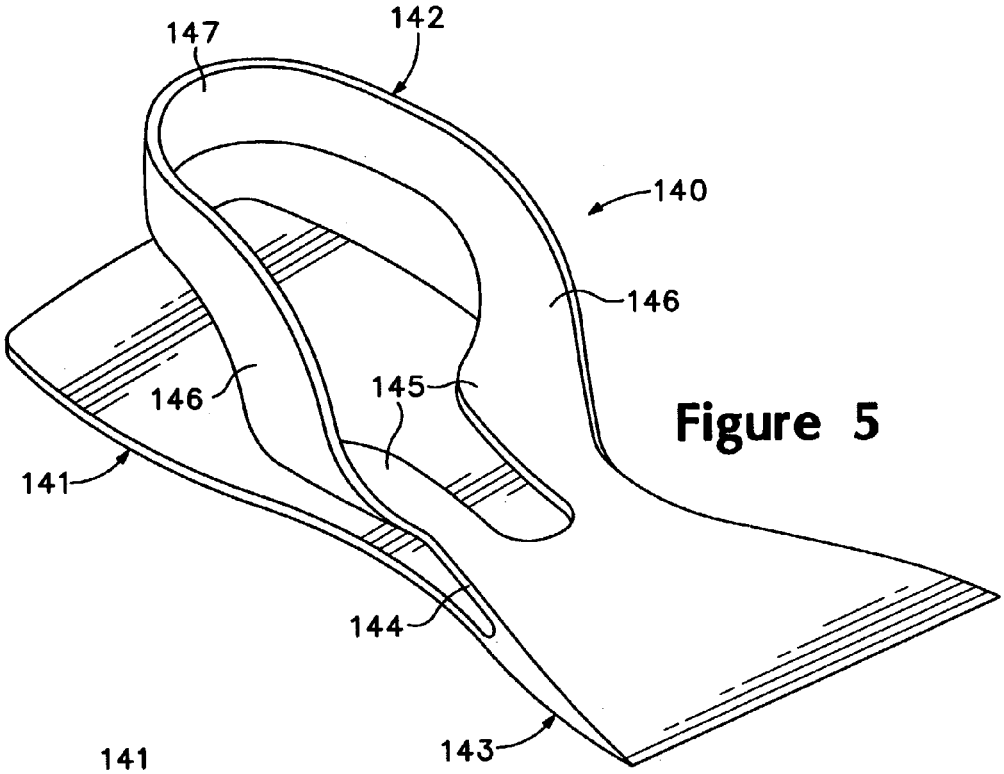
FIG. 5 is a perspective view of a frame portion of the article of footwear.
Figure 6:
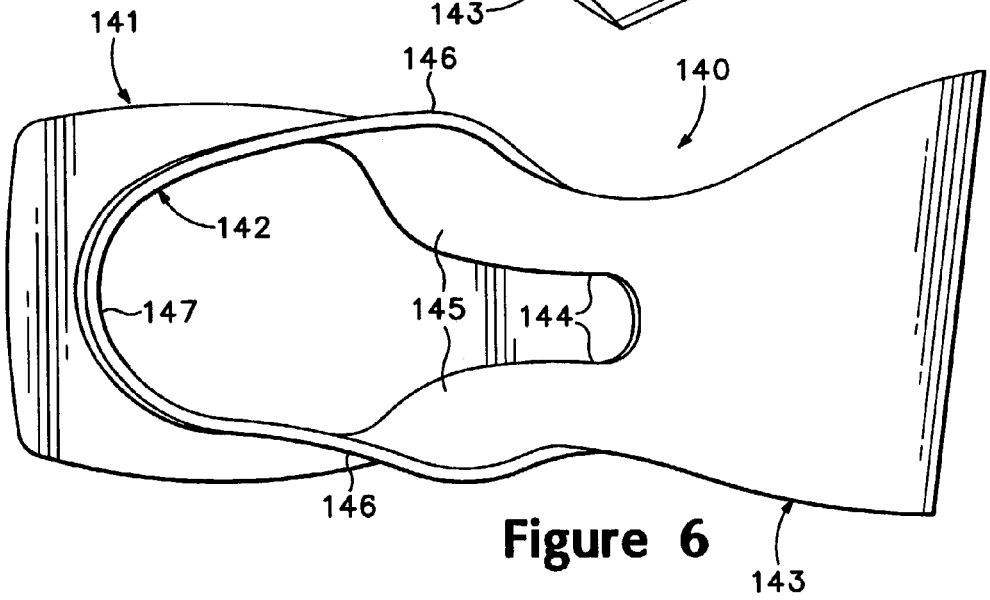
FIG. 6 is a top plan view of the frame portion.

Frame 140, as depicted in FIGS. 5 and 6, includes a support section 141, a heel section 142, and a connection 143 that joins support section 141 and heel section 142. Support section 141 extends between rear element 132 and portions of outsole 150 located in rearfoot region 103. That is, support section 141 is connected, through adhesive bonding, for example, to the lower surface of rear element 132 and to the upper surface of outsole 150. The thickness of support section 141 may be substantially constant, or may decrease as support section 141 approaches heel area 104.

Heel section 142 may be divided into four general areas to aid in discussion: a first area 144, a second area 145, a third area 146, and a fourth area 147. First area 144 is immediately adjacent to connection 143, is positioned between fore element 131 and rear element 132, and may extend from medial side 105 to lateral-side 106. As discussed with reference to midsole 130, fore element 131 and rear element 132 taper in midfoot region 102. First area 144, therefore, extends in a backwardly-diagonal direction between the tapered portions of midsole 130. Second area 145 follows the contour of rear element 132 and extends between upper 110 and rear element 132. Second area 145 includes portions located on medial side 105 and lateral side 106, which may be separate from each other or connected together across the area between upper 110 and rear element 132. Whereas second area 145 forms generally horizontal surfaces, third area 146 forms vertical surfaces. Third area 146 projects out of the area between upper 110 and rear element 132 and turns upward, thereby extending onto the sides of upper 110 in a generally rearward and upwardly-slanted direction. In heel area 104, heel section 142 curves backward to form fourth area 147, which extends in a generally horizontal direction around the sides and rear of heel area 104. First area 144, second area 145, and third area 146 include portions located on medial side 105 and lateral side 106. Portions of fourth area 147 are also located on medial side 105 and lateral side 106, but extend around the back of heel area 104, where they meet and are joined together.

The configuration of heel section 142 discussed above provides a structure that extends around the heel of the wearer, thereby stabilizing the heel to ensure that the heel remains positioned above rear element 132. Two factors that affect the stability are the dimensions of heel section 142 and the material selected for frame 140. One skilled in the relevant art will be able to select a combination of dimensions and materials that provides proper stability. In general, however, frame 140 will be formed of a semi-rigid, lightweight polymer, such as the various polymer materials in the nylon or polyamide families. Accordingly, a thickness of heel section 142 that ranges from 1 to 2 millimeters and a width of third area 146 and fourth area 147 in the range of 15–30 millimeters will generally provide sufficient stability and structural stability to hold the heel of the individual over rear element 132.

Connection 143, which is generally located in midfoot region 102, joins support section 141 with heel section 142. With reference to the side elevational views of FIGS. 1 and 2, frame 140 has a tapered shape that may be generally approximated by analogy to a V-shape, wherein support section 141 forms a first segment of the V-shape, heel section 142 forms a second segment of the V-shape, and connection 143 forms the point that forms the junction between support section 141 and heel section 142. As depicted in the figures, connection 143 has a greater thickness than other portions of frame 140, particularly in the area that joins with support section 141 and heel section 142. This structure ensures that the high stresses induced in connection 143 during running or other activities, due to the separation of upper 110 and rear element 132, do not separate or otherwise compromise the durability of the connection between support section 141 and heel section 142.

Outsole 150 is connected to the lower surface of fore element 131 and the lower surface of support section 141. In general, outsole 150 provides the primary surface that engages the ground while footwear 100 is worn. Outsole 150 is, therefore, formed of a durable, wear-resistant material, such as carbon black rubber compound, and may incorporate a plurality of projections that enhance the traction of footwear 100.

The sole structure of a conventional article of footwear is often connected to the upper along the entire length of the footwear. In contrast, the structure of footwear 100 discussed above provides a configuration wherein upper 110 and sole structure 120 remain unconnected through a majority of rearfoot region 103, thereby decoupling upper 110 and sole structure 120 in rearfoot region 103. In order to provide additional stability to this structure, heel section 142 extends around the heel of the wearer.

Frame 140 may also be configured to provide a spring-like structure within footwear 100. As discussed above, frame 140 may be formed of a semi-rigid, lightweight polymer. Upon the application of a downward force to sole structure 120, support section 141 and heel section 142 are compressed toward each other, thereby inducing a bending force through heel section 142 and connection 143. More particularly, as footwear 100 contacts the ground, first area 144 and second area 145 will bend to absorb impact energy and attenuate a portion of the ground reaction forces induced during contact. That is, first area 144 and second area 145 will bend to provide cushioning. In addition, third area 146 and fourth area 147 extend onto sides of upper 110 and around heel area 104 to provide stability for the heel.

The percentage of absorbed energy and attenuated ground reaction forces will generally depend upon the specific material forming frame 140 and the thickness of the material forming frame 140. Frame 140 may be configured to absorb impact energy and attenuate relatively large portion of the ground reaction forces induced during contact. As depicted in the figures, however, frame 140 works in conjunction with midsole 130 to absorb impact energy and attenuate ground reaction forces. In operation, frame 140 provides cushioning as heel section 142 bends downward. As the bending of frame 140 increases, the degree of contact between upper 110 and rear element 132 of midsole 130 increases, thereby causing midsole 130 to supplement the energy absorption and ground reaction force attenuation. Accordingly, frame 140 absorbs an initial portion of the impact energy and attenuates an initial portion of the ground reaction forces, and midsole 130 continues the absorption and attenuation.

A benefit to the system discussed above is that the heel area 104 of upper 110 directly contacts midsole 130 rather than a stiff moderator or spring plate. The Background of the Invention section discloses articles of footwear with a spring system within the sole structure. In U.S. Pat. No. 6,029,374 to Herr et al., for example, the spring system includes a moderator or spring plate that extends under the heel portion of the upper. In footwear 100, however, frame 140 extends onto sides of upper 110 and around heel area 104. In this configuration, a significant portion of upper 110, which corresponds with the heel of the foot, is exposed so as to make direct contact with midsole 130. The heel of the foot is, therefore, directly cushioned by midsole 130, rather than a stiff moderator or spring plate.

The various portions of the lower surface of upper 110 may be classified as being secured to midsole 130, secured to frame 140, or unsecured to either midsole 130 or frame 140. Approximately one-half of upper 130, which extends from forefoot region 101 to midfoot region 102, is secured to midsole 130. The bottom surface of upper 110 is then at least partially secured to frame 140, or second area 145 more particularly, in the following quarter of upper 110. Finally, the rear quarter of the lower surface of upper 110 is unsecured to midsole 130 or frame 140, but does contact midsole 130 when footwear 100 impacts the ground. Accordingly, frame 140 does not extend under at least the rear quarter of upper 110 so as to permit upper 110 to contact midsole 130 in heel area 104.

As discussed briefly above, a portion of upper 110 positioned in rearfoot region 103 may be formed of a material 111 that extends under the heel of the foot of the individual and permits ventilation of upper 110. Frame 140 extends onto the sides of upper 110 and around heel area 104. This structure supports the foot above rear element 132 and provides a structure that supports material 111. That is, material 111 may be effectively suspended from frame 140, or material 111 may be secured to the materials forming upper 110, which are secured to frame 140. This structure forms a relatively small amount of pressure points in rearfoot region 103 and suspends the heel above rear element 132 when footwear 100 is not in contact with the ground. As footwear 100 is compressed against the ground, as during running or walking, rear element 132 contacts material 111 (i.e., contacts the heel) and serves to attenuate ground reaction forces and absorb energy, thereby providing cushioning.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear having a forefoot region and a rearfoot region, the article of footwear comprising:

an upper for receiving a foot of a wearer, the upper having a heel portion, a lateral side, a medial side, and a lower surface extending between the lateral side and the medial side; and a sole stroke having:

a midsole that is secured to the upper in the forefoot region, at least a portion of an upper surface of the midsole being unsecured to the upper in the rearfoot region to form a disconnected area between the upper surface of the midsole and the lower surface of the upper, and a frame element extending above the disconnected area and around the heel portion of the upper, the frame element extending below the disconnected area and under the midsole in the rearfoot region, and the frame element being absent from at least a portion of the disconnected area.

2. The article of footwear of claim 1, wherein an outsole is secured to the midsole in the forefoot region, and the outsole is secured to the frame element in the rearfoot region.

3. The article of footwear of claim 1, wherein the midsole includes a fore element and a separate rear element.

4. The article of footwear of claim 3, wherein the frame element separates the fore element and the rear element.

5. An article of footwear having a forefoot region and a rearfoot region, the article of footwear comprising:

an upper for receiving a foot of a wearer, the upper having a heel portion, a lateral side, a medial side, and a lower surface extending between the lateral side and the medial side; and a sole structure having:

a midsole with a forefoot element positioned in the forefoot region and a: rearfoot element positioned in the rearfoot region, the rearfoot element having an per surface, at least a portion of the upper surface being unsecured to the upper to define a disconnected area between the upper surface of the midsole and the lower surface of the upper, the disconnected area forming a space between at least a portion of the upper surface of the midsole and the lower surface of the upper, and a frame element with a v-shaped configuration having a support section and a heel section, the support section being positioned below the disconnected area, and the heel section extending above the disconnected area and around the heel portion of the upper, the fame element being absent from at least a portion of the disconnected area to permit the lower sure of the upper to contact the upper surface of the midsole in the rearfoot region, wherein the disconnected area forms a separation between an upper portion of the footwear and a lower portion of the footwear that permits at least a portion of the heel section of the frame element to move independent of the rearfoot element and the support section of the frame element.

6. The article of footwear of claim 5, wherein a point of the v-shaped configuration of the frame element separates and is positioned between the forefoot element and the rearfoot element.

7. The article of footwear of claim 5, wherein the heel section of the frame element is secured to the heel portion of the upper.

8. The article of footwear of claim 5, wherein the support section extends under the rearfoot element.

9. The article of footwear of claim 8, wherein an outsole is secured to the forefoot element in the forefoot region, and the outsole is secured to the support section in the rearfoot region.

10. The article of footwear of claim 5, wherein the rearfoot element and the support section extend beyond the upper in a rearward direction, and a width of the rearfoot element and the support section in at least a portion of the rearfoot region are greater than a width of the upper in the rearward region.

11. The article of footwear of claim 5, wherein:

a first portion of the heel section extends between the forefoot element and the rearfoot element, a second portion of the heel section extends between the rearfoot element and the lower surface of the upper, a third portion of the heel section extends onto the medial side and the lateral side of the upper, and a fourth portion of the heel section extends around the heel portion of the upper.

12. The article of footwear of claim 5, wherein a portion of the upper is suspended from the frame element in the rearfoot region.

13. An article of footwear having an upper for receiving a foot of a wearer and a sole structure for supporting the foot, the sole structure comprising:

a midsole formed of a foamed polymer material and having a first midsole element and a second midsole element, the first midsole element being positioned in a forefoot region of the footwear and connected to the upper, and the second midsole element being positioned in a rearfoot region of the footwear, at least a portion of the second midsole element being unsecured to the upper to define a disconnected area between the second midsole element and the upper in the rearfoot region, the disconnected area forming a space between at least a portion of the upper surface of the midsole and the lower surface of the upper;

a frame element formed of a semi-rigid polymer material and having a support section and a heel section that are connected to each other in a midfoot region of the footwear, the support section extending under the second midsole element and being secured to a lower surface of the second midsole element, and the heel section extending above the second midsole element and onto a heel portion of the upper; and an outsole secured to a lower surface of the first midsole element and a lower surface of the support section, wherein the disconnected area extends through the footwear from a lateral side of the rearfoot region to a medial side of the rearfoot region to separate an upper portion and a lower portion of the footwear in the rearfoot region, the frame element being absent from at least a portion of the disconnected area to permit the upper to contact the midsole upon downward deflection of the upper and the heel section of the frame element.

14. The article of footwear of claim 13, wherein the heel section of the frame element is secured to the heel portion of the upper.

15. The article of footwear of claim 14, wherein:

a first portion of the heel section extends between the second midsole element and the upper, a second portion of the heel section extends onto sides of the upper, and a third portion of the heel section extends around the heel portion of the upper.

16. The article of footwear of claim 14, wherein the second midsole element, the support section, and the outsole extend beyond the upper in a rearward direction, and a width of the second midsole element, the support section, and the outsole in the rearfoot region are greater than a width of the upper in the rearward region.

* * * * *